US011201041B2

(12) United States Patent
McKinny et al.

(10) Patent No.: US 11,201,041 B2
(45) Date of Patent: Dec. 14, 2021

(54) GAS ELECTRON MULTIPLIER BOARD PHOTOMULTIPLIER

(71) Applicant: Baker Hughes Holdings LLC, Houston, TX (US)

(72) Inventors: Kevin Scott McKinny, Hudson, OH (US); Casey Hale, Streetsboro, OH (US); Christopher Freeman, Twinsburg, OH (US); Jonas Burke, Akron, OH (US); Matthew Steinhart, Stow, OH (US); Matthew Mcpheeters, Akron, OH (US)

(73) Assignee: BAKER HUGHES HOLDINGS LLC, Houston, TX (US)

( * ) Notice: Subject to any disclaimer, the term of this patent is extended or adjusted under 35 U.S.C. 154(b) by 0 days.

(21) Appl. No.: 17/158,668

(22) Filed: Jan. 26, 2021

(65) Prior Publication Data

US 2021/0242002 A1 Aug. 5, 2021

Related U.S. Application Data

(60) Provisional application No. 62/969,389, filed on Feb. 3, 2020.

(51) Int. Cl.

| | |
|---|---|
| ***H01J 43/08*** | (2006.01) |
| ***H01J 43/28*** | (2006.01) |
| ***H01J 43/22*** | (2006.01) |

(52) U.S. Cl.

CPC ..... *H01J 43/08* (2013.01); *H01J 43/22* (2013.01); *H01J 43/28* (2013.01)

(58) Field of Classification Search

None

See application file for complete search history.

(56) References Cited

U.S. PATENT DOCUMENTS

| | | | | |
|---|---|---|---|---|
| 2002/0041154 | A1 | 4/2002 | Tomasetti et al. | |
| 2008/0245951 | A1 | 10/2008 | Nakaya | |
| 2008/0283725 | A1 | 11/2008 | Hahn et al. | |
| 2017/0069455 | A1 | 3/2017 | Chuang et al. | |
| 2019/0146117 | A1* | 5/2019 | Yaish | H01J 49/025 250/288 |

FOREIGN PATENT DOCUMENTS

WO 2007-063678 A1 6/2007

OTHER PUBLICATIONS

International Search Report and Written Opinion issued in corresponding International Application No. PCT/US2021/016311, dated Jul. 8, 2021, 7 pages.

* cited by examiner

*Primary Examiner* — Ashok Patel

(74) *Attorney, Agent, or Firm* — Mintz Levin Cohn Ferris Glovsky and Popeo, PC; Lisa Adams

(57) ABSTRACT

A photomultiplier includes a housing including a proximal end and a distal end, an optical window disposed at the proximal end of the housing, an end-wall plate disposed at the distal end of the housing, a feedthrough that penetrates through the end-wall plate, and a gas electron multiplier (GEM) board disposed between the optical window and the end-wall plate.

20 Claims, 8 Drawing Sheets

GAS ELECTRON MULTIPLIER BOARD PHOTOMULTIPLIER

CROSS-REFERENCE TO RELATED APPLICATIONS

This application claims the benefit of U.S. Provisional Patent Application No. 62/969,389, filed on Feb. 3, 2020 and entitled "Gas Electron Multiplier Board Photomultiplier," the entirety of which is incorporated by reference.

BACKGROUND

A photomultiplier tube (PMT) can detect light in the ultraviolet, visible, and near-infrared ranges of the electromagnetic spectrum by transferring the energy of absorbed photons to emitted electrons to produce an electrical signal. Some PMTs use a vacuum tube and dynode structure for electron multiplication. They multiply the current produced by incident light by as much as 100 million times (e.g., about 160 dB), in multiple dynode stages, and thereby enable a low detection threshold.

Some PMTs are constructed based on a glass housing, which is maintained under a vacuum pressure. However, such PMTs can be fragile and unable to withstand high temperature or vibration, for example, because they can use vacuum glass tube structure and the internal structure (e.g., dynode structure and connections) can be intricate and delicate.

SUMMARY

In an embodiment, a device includes a housing, an optical window, an end-wall plate, a feedthrough, and a gas electron multiplier (GEM) board. The housing can include a proximal end and a distal end. The optical window can be disposed at the proximal end of the housing. The end-wall plate can be disposed at the distal end of the housing. The feedthrough can penetrates through the end-wall plate. The gas electron multiplier (GEM) board can be disposed between the optical window and the end-wall plate.

One or more of the following features can be included in any feasible combination. For example, the device can include a photocathode coated as a thin film on a surface the optical window. The photocathode can include potassium sodium antimonide. The feedthrough can include: an electrically conductive wire that penetrates through the end-wall plate; and a hermetic seal between the electrically conductive wire and the end-wall plate. The optical windows can include sapphire. The housing can include titanium or aluminum. The device can include a gas mix, where the gas mix includes a proportional gas. The proportional gas can include one of Group 18 of the periodic table or nitrogen. The gas mix can further include a quench gas. The quench gas can include one of $CO_2$, $CH_4$, or $CF_4$. The photocathode can include at least one layer of vapor deposited material. A thickness of one or more of the at least one layer of vapor deposited material can be less than or equal to about 200 nanometers.

One or more of the at least one layer of vapor deposited material can include a minimum of 90 weight-% of one or more material selected from the group consisting of Antimony (Sb), Antimony, compound with potassium (1:1) (KSb), Antimony, compound with potassium (2:1) ($KSb_2$), Antimony, compound with potassium (5:4) ($K_5Sb_4$), Antimony Trioxide ($Sb_2O_3$), Cesium (Cs), Cesium Antimonide ($Cs_3Sb$), Gallium Arsenide (GaAs), Gallium Arsenide with Cesium (GaAs(Cs)), Cesium Bismuthide ($Cs_3Bi$), Cesium Bismuthide with Oxygen ($Cs_3Bi(O)$), Cesium Bismuthide with Silver ($Cs_3Bi(Ag)$), Cesium Iodide (CsI), Cesium Oxide ($Cs_2O$), Cesium Telluride ($Cs_2Te$), Gallium Aluminum Arsenide ($Ga_{0.25}Al_{0.75}As$), Gallium Arsenide Phosphide ($GaAs_{1-x}P_x$), Gallium Arsenide Phosphide with Cesium ($GaAs_{1-x}P_x(Cs)$), Gallium Nitride (GaN), Gallium Nitride with Cesium (GaN(Cs)), Gallium Phosphide (GaP), Indium Gallium Arsenide (InGaAs), Indium Gallium Arsenide with Cesium (InGaAs(Cs)), Indium Gallium Arsenide Phosphide (InGaAsP), Indium Gallium Arsenide Phosphide with Cesium (InGaAsP(Cs)), Indium Phosphide (InP), Lithium Antimonide ($Li_3Sb$), Oxygen (O), Potassium (K), Potassium Antimonide ($K_3Sb$), Potassium Bromide (KBr), Potassium Cesium Antimonide ($K_2CsSb$), Potassium Chloride (KCl), Potassium Oxide ($K_2O$), Potassium Sodium Cesium Antimonide ($(Cs)Na_2KSb$), Sodium (Na), Sodium Antimonide ($Na_3Sb$), Sodium Arsenide ($Na_3As$), Sodium Cesium Antimonide ($Na_2CsSb$), Sodium Oxide ($Na_2O$), Sodium Potassium Antimonide ($Na_2KSb$), Rubidium Cesium Antimonide ($Rb_2CsSb$), Silver (Ag), Silver Bismuth Oxygen Cesium (Ag—Bi—O—Cs), Silicon-Carbide (SiC), and Silver Oxygen Cesium (Ag—O—Cs).

One or more of the at least one layer of vapor deposited material can include a minimum of 90 weight-% of one or more material selected from the group consisting of Aluminum (Al), Antimony (Sb), Arsenic (As), Bismuth (Bi), Bromine (Br), Cesium (Cs), Chlorine (Cl), Gallium (Ga), Indium (In), Lithium (Li), Oxygen (O), Phosphorous (P), Potassium (K), Rubidium (Rb), Silver (Ag), Sodium (Na), and Tellurium (Te). One or more of the at least one layer of vapor deposited material can include a minimum of 90 weight-% of one or more material selected from the group consisting of Silicon (Si), Boron Nitride (BN), Titanium Dioxide ($TiO_2$), Silicon Carbide (SiC), and Silicon Dioxide ($SiO_2$). An electric potential difference can be applied between the photocathode and the GEM board. The device can include a readout anode. The device can include a focusing element. The focusing element can include conducting cylinders or rings. The housing can be cylindrical.

BRIEF DESCRIPTION OF THE DRAWINGS

A brief description of each drawing is provided to more sufficiently understand drawings used in the detailed description of the present disclosure.

It should be understood that the above-referenced drawings are not necessarily to scale, presenting a somewhat simplified representation of various features illustrative of the basic principles of the disclosure. The specific design features of the present disclosure, including, for example, specific dimensions, orientations, locations, and shapes, will be determined in part by the particular intended application and use environment.

DETAILED DESCRIPTION

Some photomultiplier tubes (PMTs), due to a glass vacuum tube structure, can be fragile and incompatible with working environments that expose the PMTs to high temperature and high vibration, such as downhole drilling applications. Glass vacuum tube PMTs can also be unreliable and expensive. Accordingly, embodiments of the present disclosure provide an improved photomultiplier that addresses these deficiencies. As an example, the improved photomultiplier can include a ruggedized housing and a gas electron multiplier (GEM) board that improves shock and vibration performance. In some embodiments, the dynode structure can be replaced with one or more GEM boards to reduce the length of the device. Applications of the improved photomultiplier can include, but are not limited to, gamma ray detection in downhole drilling applications, radioactivity detection for security applications, healthcare applications, and the like.

Figure 1:
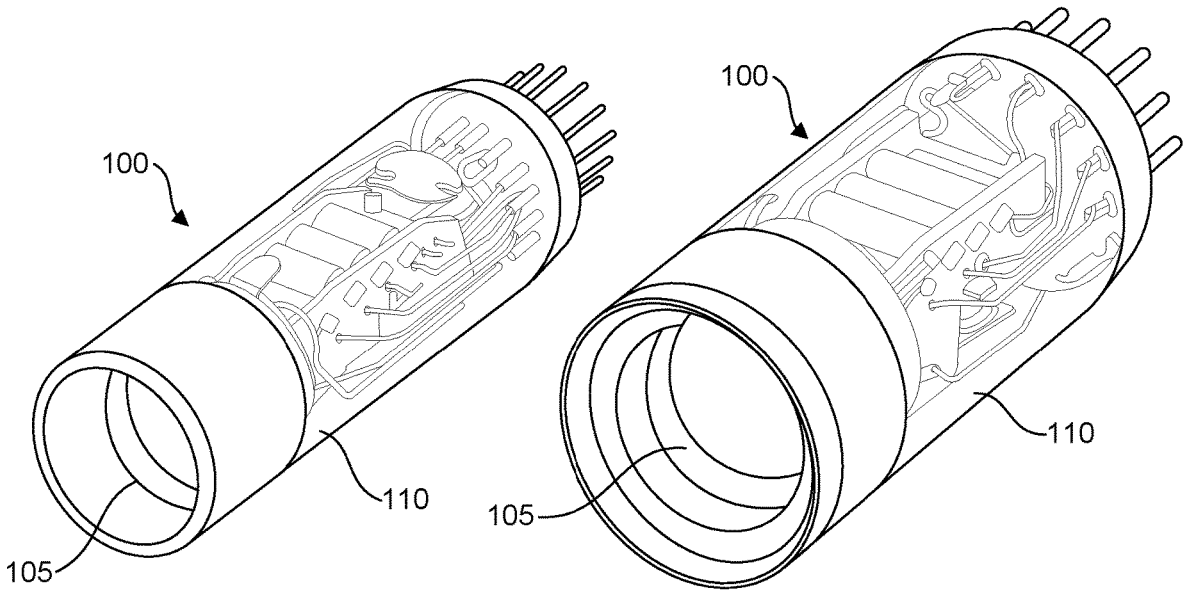
FIG. 1 shows an example of a vacuum tube photomultiplier with dynodes.
Figure 2:
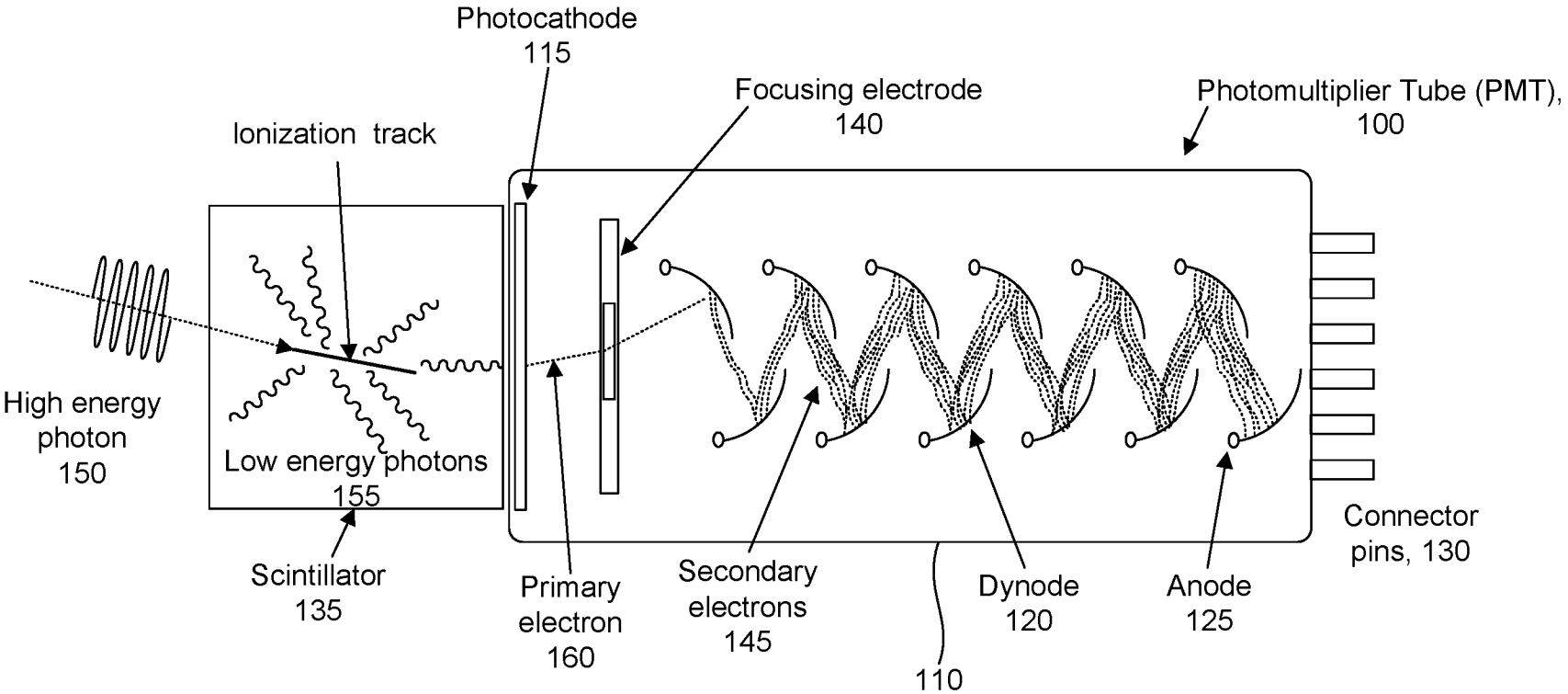
FIG. 2 shows a schematic illustration of the vacuum tube photomultiplier with dynodes.

FIG. 1 shows an example of a vacuum tube photomultiplier that uses dynodes 100, and FIG. 2 shows a schematic illustration of the vacuum tube photomultiplier with dynodes 100. Referring the FIG. 2, the vacuum tube photomultiplier with dynodes 100 can receive incident light through an optical window 105 disposed at an end of a glass tube 110. The glass tube 110 is maintained under a vacuum pressure. A photocathode 115 is disposed on the optical window 105, a plurality of dynodes 120 are disposed within the glass tube 110, and an anode 125 is disposed after the plurality of dynodes 120. Each of the anode 125 and the plurality of dynodes 120 are connected to connector pins 130 through feedthroughs. In operation, an incident photon can strike the photocathode 115 material, which can be in the form of a thin, conducting layer deposited (e.g., vapor deposited) on an interior surface of the optical window 105. Electrons can be emitted from the surface of the photocathode 115 material due to the photoelectric effect. The emitted electrons can be directed by a focusing electrode 140 toward the electron multiplier, where the electrons are multiplied by the secondary emission. Each of the dynodes 120 can be subject to an incrementally higher positive potential (e.g., by about 100 Volts) than the preceding dynode to attract the electrons and produce more secondary electrons 145. In some embodiments, depending on a target wavelength of detection, a scintillator 135 can be disposed in front of the optical window 105. For example, in order to detect gamma rays, high energy photons 150 can be converted to low energy photons 155 within the scintillator 135, and the low energy photons 155 can be converted into primary electrons 160 by the photocathode 115.

Figure 3:
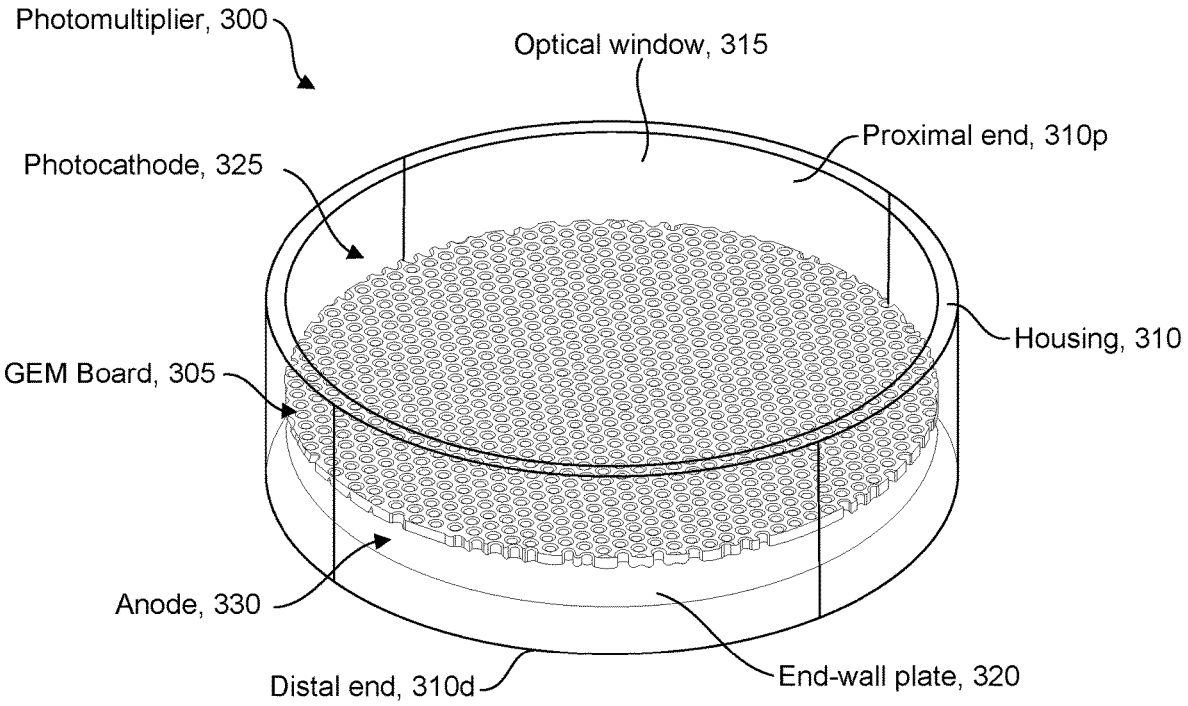
FIG. 3 shows a schematic view of a photomultiplier using a gas electron multiplier (GEM) board according to an exemplary embodiment.
Figure 6A:
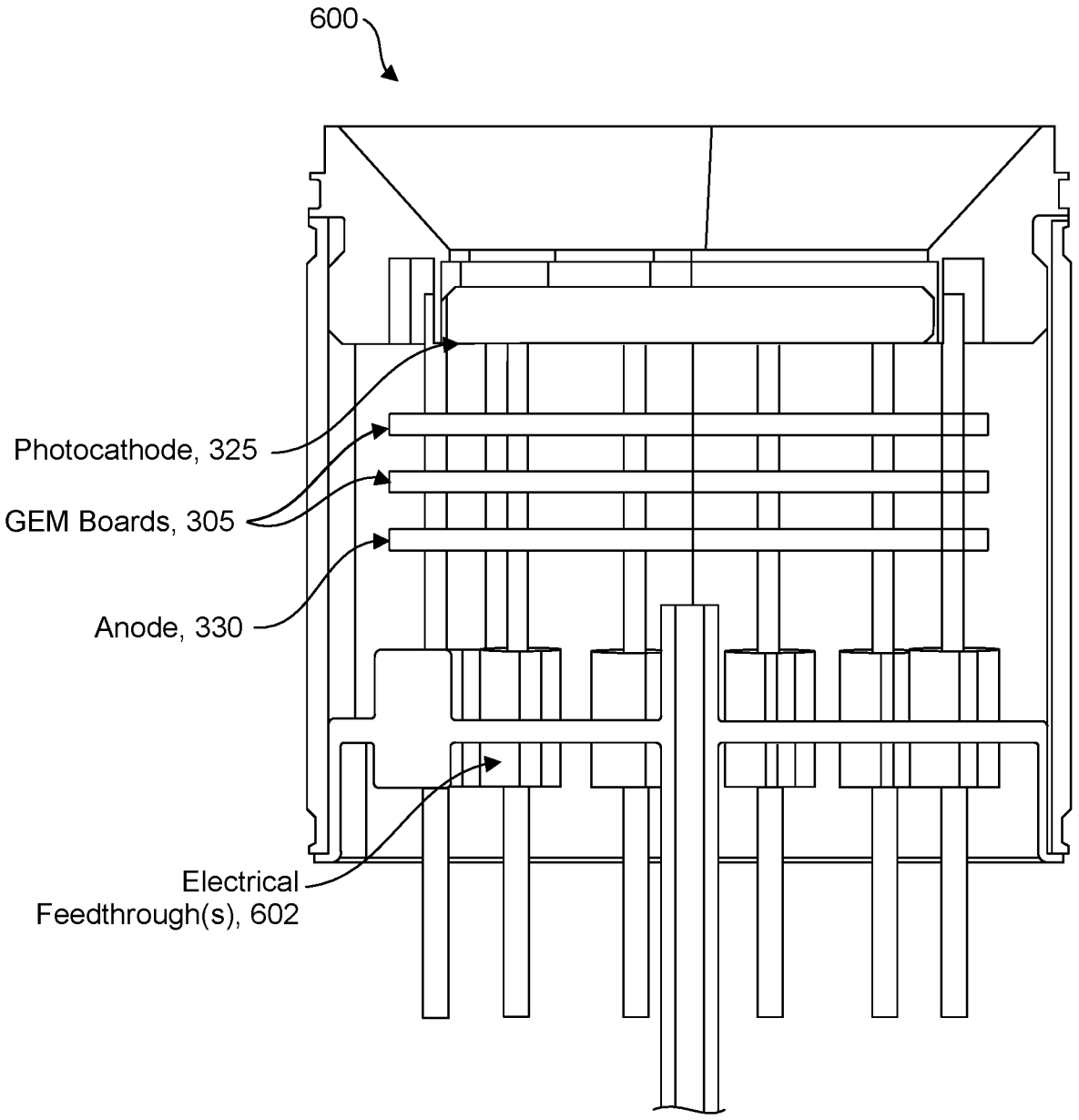
FIG. 6A shows a schematic, side cross-sectional view of another example photomultiplier using a GEM board according to an exemplary embodiment of the present disclosure.
Figure 6B:
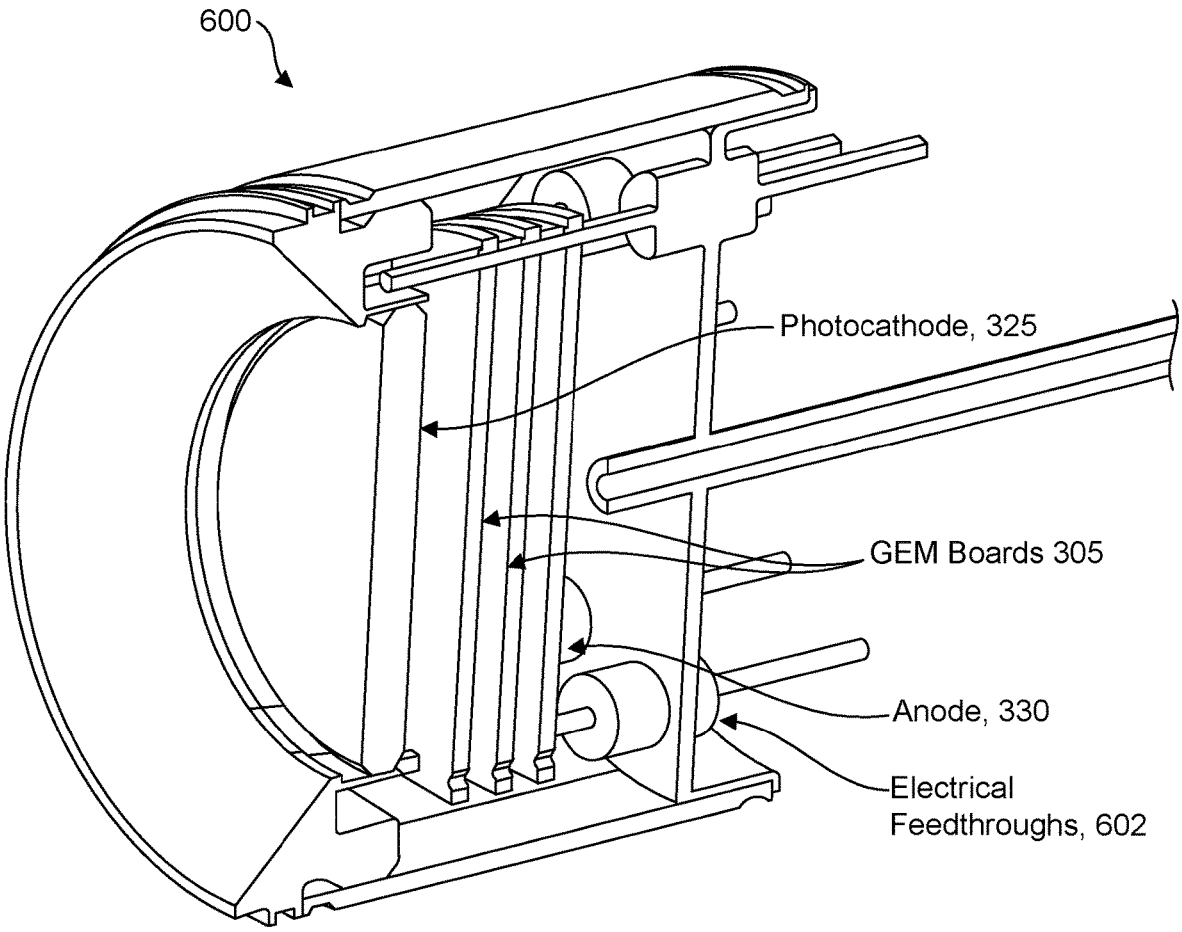
FIG. 6B shows an isometric cross-sectional view of the photomultiplier of FIG. 6A.

FIG. 3 shows a schematic view of one exemplary embodiment of a photomultiplier 300 using a gas electron multiplier (GEM) board 305 according to an exemplary embodiment of the present disclosure. FIGS. 6A-6B illustrate another exemplary photomultiplier using a GEM board. Referring to FIG. 3, the photomultiplier 300 can include a housing 310, which includes a proximal end 310*p* and a distal end 310*d*. The photomultiplier 300 can include an optical window 315 disposed at the proximal end of the housing 310 and an end-wall plate 320 disposed at the distal end 310*d* of the housing 310. The GEM board 305 can be disposed between the optical window 315 and the end-wall plate 320. A feedthrough that penetrates through the end-wall plate 320 can be included to make electrical connections to the GEM.

The housing 310 can include a rugged material such as a metal. In some implementations, the housing 310 can be formed from a materials including, but not limited to, titanium, aluminum, or alloys thereof. In some implementations, materials such as glass be utilized. However, the material forming the housing 310 is not limited thereto, and various other rugged materials can be used.

The optical window 315 can include a rugged and optically transmissive material. In some implementations, the optical window 315 can be formed from sapphire. Sapphire can provide advantages when used as to form the optical window 315 due to a wide optical transmission band from ultraviolet to near-infrared, a high mechanical strength, a high scratch and abrasion resistance, and a high temperature capability.

The end-wall plate 320 can also be formed from a rugged material. In some implementations, the end-wall plate 320 can be formed from the same metal material as the housing 310. In other embodiments, the end-wall plate 320 can be formed from a different material from the housing 310. In certain embodiments, the end-wall plate 320 can be formed from a ceramic or a metal. In implementations in which the end-wall plate 320 is formed from a conductive material (e.g., a metal), feedthroughs for connector pins can be insulated. Those insulators may include ceramic or glass, sealed to the end-wall plate 320 using glass-to-metal or ceramic-to-metal seals, for example.

Due to the use of rugged materials to form the housing 310, the optical window 315, and the end-wall plate 320, embodiments of the photomultiplier 300 can withstand high temperature operations and/or high vibration environment.

In some embodiments, the housing 310 can be formed in a substantially cylindrical geometry. For example, a diameter of the housing 310 can be within the range from about ½ inch to about 1 inch (e.g., about ½ inches, about ¾ inches, or about 1 inch). For example, a characteristic length of the housing 310 can be within the range from about ½ inches to about 3 inches. However, the dimensions of the photomultiplier 300 according to embodiments of the present disclosure are not limited thereto, and the dimensions can be modified variously based on design requirements and applications.

In some embodiments, a photocathode 325 can be formed by coating a photocathode material on an interior surface of the optical window 315. The photocathode material can be deposited as a thin film. Any thin film deposition methods can be used to form the photocathode 325. For example, chemical deposition such as plating, chemical solution deposition (CSD), chemical bath deposition (CBD), Langmuir-Blodgett method, spin coating, dip coating, chemical vapor deposition (CVD) plasma enhanced CVD, and atomic layer deposition (ALD); or physical deposition such as physical vapor deposition (PVD), molecular beam epitaxy (MBE), sputtering, laser deposition, and electrospray deposition can be used to coat the photocathode 325 on the optical window 315 (e.g., a sapphire optical window).

In some implementation, the photocathode 325 can include at least one layer of vapor deposited material. For example, one to about 20 layers of vapor deposited material can be employed to form the photocathode 325. A thickness of each of the at least layers of vapor deposited material can be less than or equal to about 200 nanometers (nm). Embodiments of the at least one layer of vapor deposited material can include one or more material selected from the group consisting of Antimony (Sb), Antimony, compound with potassium (1:1) (KSb), Antimony, compound with potassium (2:1) ($KSb_2$), Antimony, compound with potassium (5:4) ($K_5Sb_4$), Antimony Trioxide ($Sb_2O_3$), Cesium (Cs), Cesium Antimonide ($Cs_3Sb$), Gallium Arsenide (GaAs), Gallium Arsenide with Cesium (GaAs(Cs)), Cesium Bismuthide ($Cs_3Bi$), Cesium Bismuthide with Oxygen ($Cs_3Bi$(O)), Cesium Bismuthide with Silver ($Cs_3Bi$(Ag)), Cesium Iodide (CsI), Cesium Oxide ($Cs_2O$), Cesium Telluride ($Cs_2Te$), Gallium Aluminum Arsenide ($Ga_{0.25}Al_{0.75}As$), Gallium Arsenide Phosphide ($GaAs_{1-x}P_x$), Gallium Arsenide Phosphide with Cesium ($GaAs_{1-x}P_x$(Cs)), Gallium Nitride (GaN), Gallium Nitride with Cesium (GaN(Cs)), Gallium Phosphide (GaP), Indium Gallium Arsenide (InGaAs), Indium Gallium Arsenide with Cesium (InGaAs(Cs)), Indium Gallium Arsenide Phosphide (InGaAsP), Indium Gallium Arsenide Phosphide with Cesium (InGaAsP(Cs)), Indium Phosphide (InP), Lithium Antimonide ($Li_3Sb$), Oxygen (O), Potassium (K), Potassium Antimonide ($K_3Sb$), Potassium Bromide (KBr), Potassium Cesium Antimonide ($K_2CsSb$), Potassium Chloride (KCl), Potassium Oxide ($K_2O$), Potassium Sodium Cesium Antimonide ((Cs) $Na_2KSb$), Sodium (Na), Sodium Antimonide ($Na_3Sb$), Sodium Arsenide ($Na_3As$), Sodium Cesium Antimonide ($Na_2CsSb$), Sodium Oxide ($Na_2O$), Sodium Potassium Antimonide ($Na_2KSb$), Rubidium Cesium Antimonide ($Rb_2CsSb$), Silver (Ag), Silver Bismuth Oxygen Cesium (Ag—Bi—O—Cs), Silicon-Carbide (SiC), and Silver Oxygen Cesium (Ag—O—Cs). These materials can be included by a minimum of 90 weight-% of each single layer of the photocathode 325.

In some embodiments, each of the at least one layer of vapor deposited material can include one or more material selected from the group consisting of Aluminum (Al), Antimony (Sb), Arsenic (As), Bismuth (Bi), Bromine (Br), Cesium (Cs), Chlorine (Cl), Gallium (Ga), Indium (In), Lithium (Li), Oxygen (O), Phosphorous (P), Potassium (K), Rubidium (Rb), Silver (Ag), Sodium (Na), and Tellurium (Te). These materials can be included by a minimum of 90 weight-% of each single layer of the photocathode 325.

In some implementations, each of the at least one layer of vapor deposited material can include one or more material selected from the group consisting of Silicon (Si), Boron Nitride (BN), Titanium Dioxide ($TiO_2$), and Silicon Dioxide ($SiO_2$). These materials can be included by a minimum of 90 weight-% of each single layer of the photocathode 325.

In some embodiments, the photocathode 325 can include potassium sodium antimonide. However, the photocathode material is not limited to the above-listed materials, and other photocathode materials can also be used.

According to embodiments of the present disclosure, a gas mix can fill an interior space defined by the housing 310, the optical window 315, and the end-wall plate 320. The gas mix can include a proportional gas. In some implementations, the proportional gas can include a Group 18 gas from the periodic table. Alternatively or additionally, the proportional gas can include nitrogen. In order to control proportionality of the current response to the light (or electromagnetic wave) intensity, a quench gas can be added in the gas mix. The quench gas can include one or more of $CO_2$, $CH_4$, or $CF_4$. The gas mix can fill the internal volume of the photomultiplier 300 at a pressure of about 1 or more atmosphere (at room temperature). In some implementations, the pressure can be less than 1 atmosphere. Since the internal volume of the photomultiplier 300 is maintained at about atmospheric pressure, the photomultiplier 300 can be less prone to implosion due to external impact during operation.

The photomultiplier 300 can include the gas electron multiplier (GEM) board 305 to augment the concentration of electrons. Multiplication can occur in holes of the GEM board due to the concentration of electric field lines, for example, as shown and described in more detail below with reference to FIG. 4A. The GEM board 305 can apply a potential difference between the two electrodes, and thereby allow electrons to be released by radiation in the gas. The released electrons can be multiplied and be transferred to a collection region.

Within the photomultiplier 300 according to an exemplary embodiment of the present disclosure, the GEM board 305 can be disposed between the optical window 315 and the end-wall plate 320. In some embodiments, more than one GEM board 305 can be disposed in series. For example, two or three GEM boards 305 can be arranged (e.g., stacked with an axial separation between each of the GEM boards 305) to increase amplification gains. Each of the GEM boards 305 can be formed as a perforated polymer foil coated with electrodes on both sides. In some implementations, the GEM board 305 can include a thin, metal-clad polymer foil, chemically perforated to include a plurality of apertures. For example, the GEM board 305 can include an approximately 50 μm thick polyamide film with a thin layer of copper electrode on each side. In some implementations, the diameter of each aperture can be a value in the range of about 0.1 mm to about 2 mm. In some implementations, the diameter of each aperture can be a value in the range of about 0.3 mm to about 1 mm. In some implementations, the thickness of the GEM board 305 can be a value in the range of about 0.01 inch to about 0.1 inch, such as 0.020 inches or 0.060 inches. In some implementations, the plurality of apertures of the GEM board 305 can be distributed across an entire area of the GEM board 305. In some implementations, the plurality of apertures can be confined within an area where the focused electron beam is impinged. In some implementations, for example for high temperature applications, the GEM board 305 can include a polyimide circuit board and/or a ceramic circuit board.

Figure 4A:
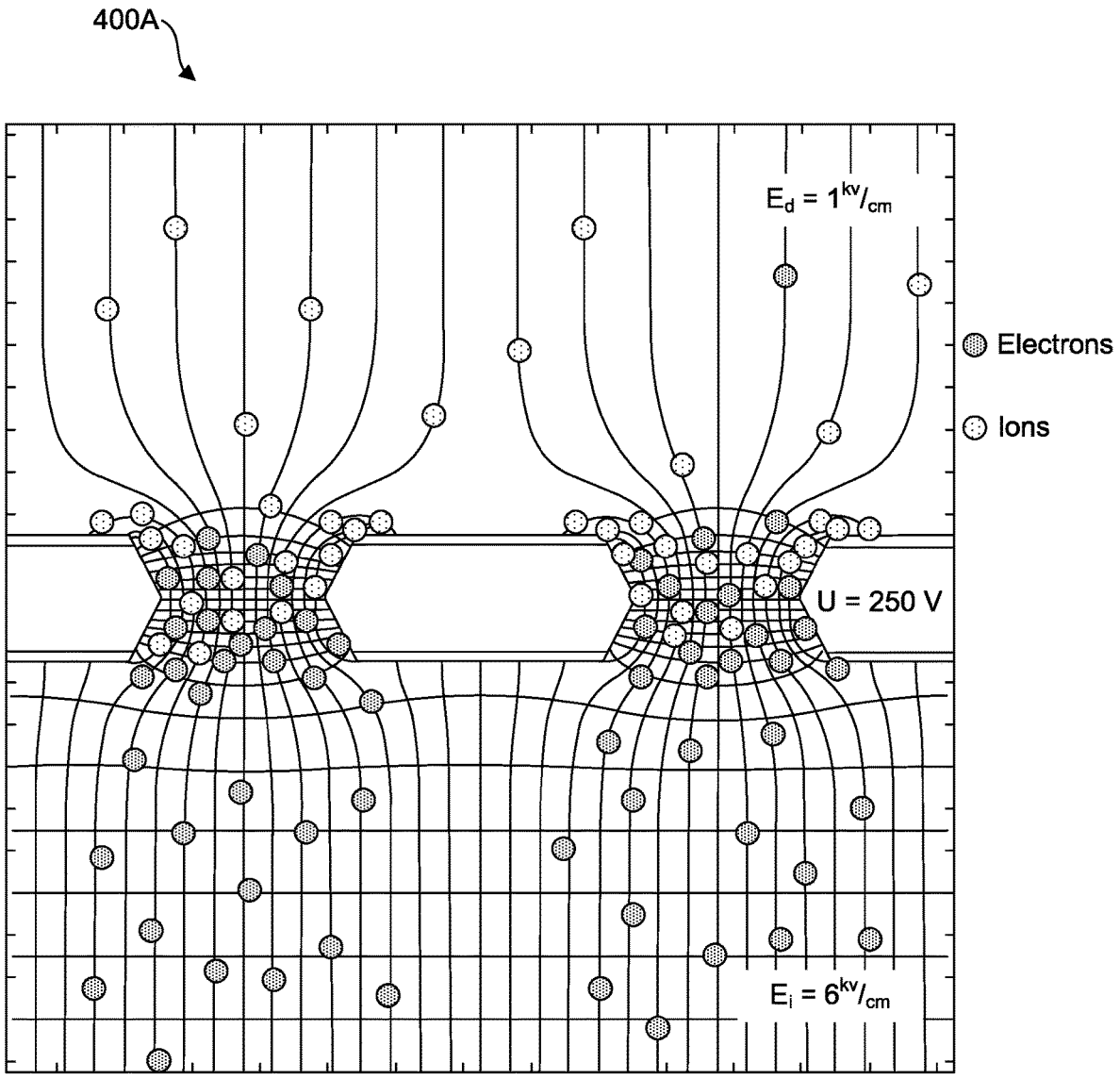
FIG. 4A schematically shows the mechanism of electron multiplication with the GEM board.
Figure 4B:
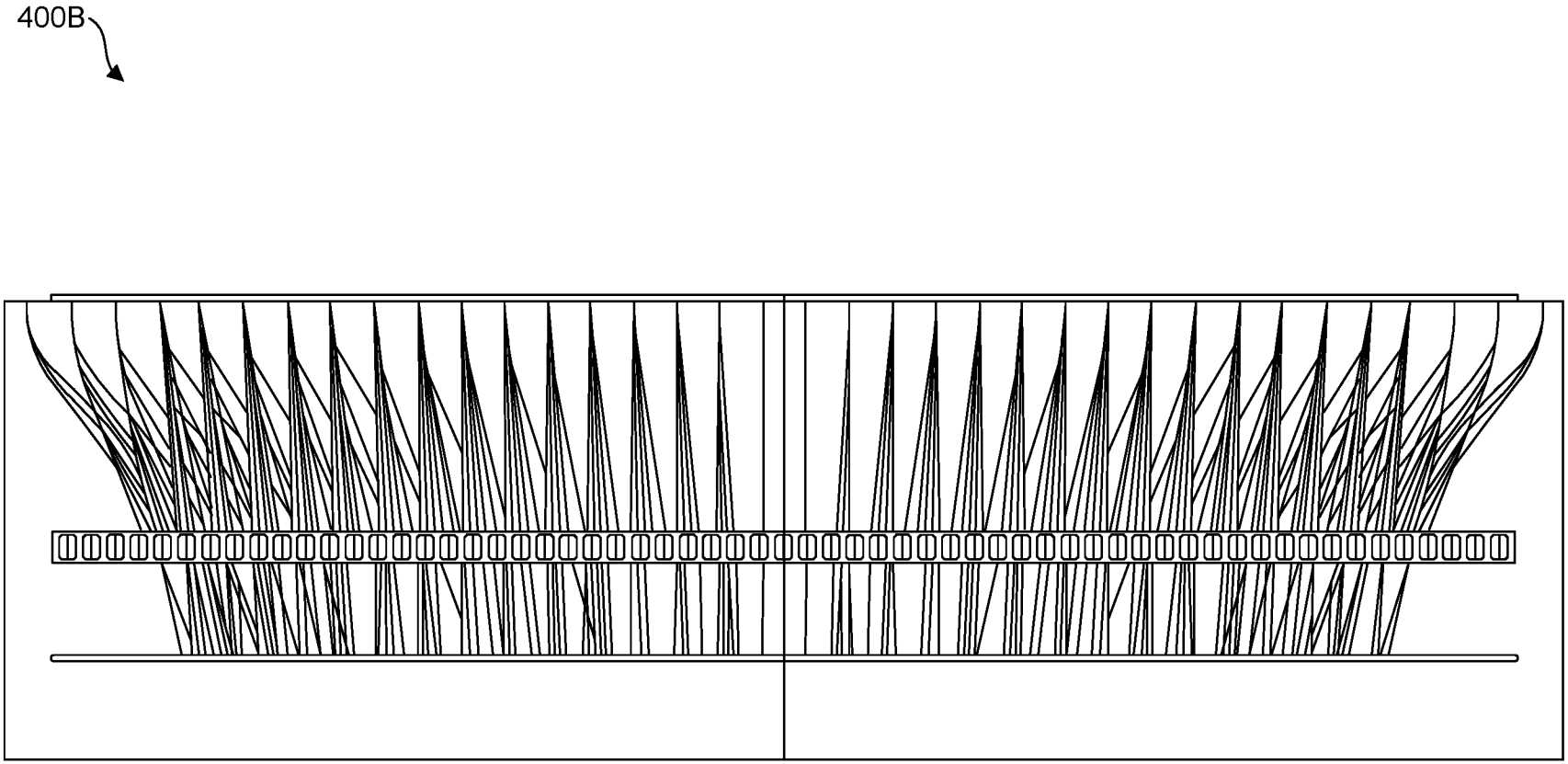
FIG. 4B schematically shows a simulation result for electron paths within a photomultiplier according to an exemplary embodiment.

FIG. 4A schematically shows the mechanism of electron multiplication 400A. As the ionized proportional gas (positive ions) drifts toward the cathode and the electrons drift toward the GEM board 305 and inside the apertures, a strong electric field is generated within the apertures. Accordingly, electrons collide with gas molecules to produce additional electrons in a cascading process. FIG. 4B is a schematic illustration of a simulation result 400B for electron paths within a photomultiplier 300 according to an exemplary embodiment of the present disclosure.

Figure 5:
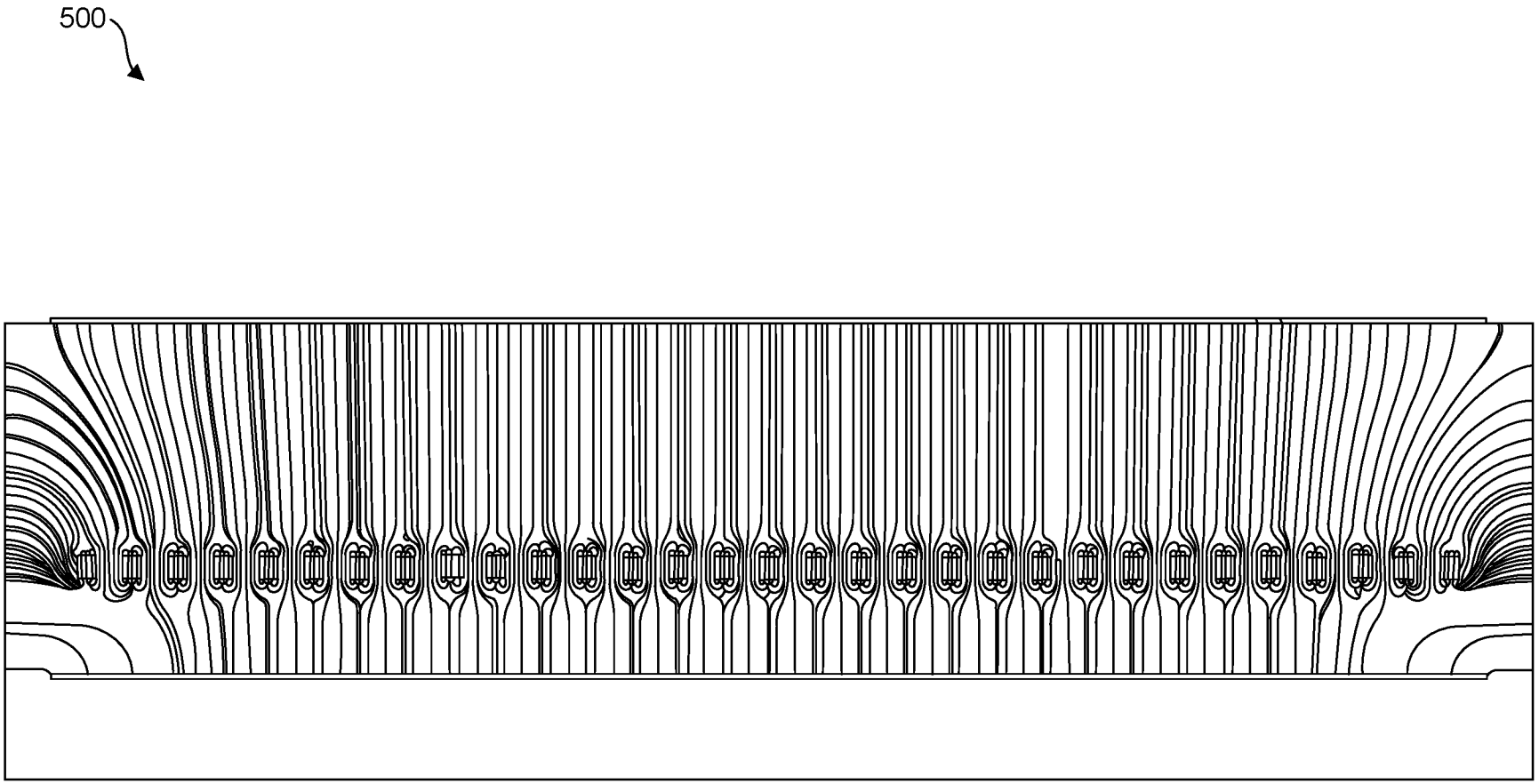
FIG. 5 schematically shows the electric potential field applied within the housing between the photocathode and a gas electron multiplier (GEM) board.

In some implementations, an electric potential difference can be applied between the photocathode 325 and the GEM board 305 to focus the electrons toward the GEM board 305. FIG. 5 schematically shows the electric potential field applied within the housing 310 between the photocathode 325 and the GEM board 305. Additionally or alternatively, a focusing element can be disposed between the photocathode 325 and the first GEM board 305 to shape the applied electric potential field within the photomultiplier 300. The focusing element can include a conducting cylinder or ring. In some embodiments, the focusing element can include a plurality of cylinders or rings.

The photomultiplier 300 according to an exemplary embodiment of the present disclosure can include a readout anode 330 between the GEM board 305 and the end-wall plate 320. The multiplied electrons can be collected to the readout anode 330 to allow the amount of current to be measured. In some implementations, the bottom of the last GEM board 305 can be used to readout the current pulse. The measured current can be converted to the light intensity based on calibration.

When a plurality of GEM boards 305 are included, the readout anode 330 can be disposed between a last GEM board 305 and the end-wall plate 320. Herein, a first GEM board and a last GEM board can be defined with respect to a traveling direction of the electrons. For example, a GEM board disposed closest to the photocathode 325 can be referred to as the first GEM board, and the GEM board disposed closest to the end-wall plate 320 can be referred to as the last GEM board.

As discussed above, in order to make electrical connections to the GEM board 305 and the readout anode 330, at least one feedthrough can be formed in the end-wall plate 320. Embodiments of the photomultiplier 300 in the form of photomultiplier 600 including electrical feedthrough(s) 602 are illustrated in FIGS. 6A-6B. The feedthrough(s) 602 can include an electrically conductive wire that penetrates through the end-wall plate 320. Between the electrically conductive wire and the end-wall plate 320, a gas-tight seal can be included. For example, a hermetic seal can be applied around the electrically conductive wire to make the gas-tight seal between the electrically conductive wire and the end-wall plate 320. Since two electrical connections are typically necessary for each GEM board 305 (for each electrode on both sides) and additional two electrical connections are necessary (one for the cathode and one for the readout anode), to accommodate n GEM boards 305, a minimum total number of 2n+2 feedthroughs 602 can be formed through the end-wall plate 320. In implementations including focusing elements, the number of feedthroughs 602 can be increased. Through the electrical feedthroughs 602, a negative voltage can be applied to the photocathode 325, and the readout anode 330 can be grounded. In some implementations, the readout anode 330 can be at positive high voltage and the photocathode at ground. The electrodes of GEM boards 305 can be maintained at intermediate (negative) voltages between the negative voltage of the photocathode and the ground voltage of the readout anode 330.

As set forth herein, photomultipliers according to exemplary embodiments of the present disclosure include a stronger optical window for the photocathode, and a ruggedized housing. Accordingly, the photomultipliers according to the present disclosure can provide high temperature resistance and shock resistance. The photomultipliers according to the present disclosure can be used for gamma ray detection in downhole drilling applications, for radioactivity detection in security applications, in healthcare applications, or the like.

Embodiments of the present disclosure are not limited to the exemplary embodiments described herein and can be embodied in variations and modifications. The exemplary embodiments are provided merely to allow one of ordinary skill in the art to understand the scope of the present disclosure, which will be defined by the scope of the claims. Accordingly, in some embodiments, well-known operations of a process, well-known structures, and well-known technologies are not described in detail to avoid obscure understanding of the present disclosure. Throughout the specification, same reference numerals refer to same elements.

The terminology used herein is for the purpose of describing particular embodiments only and is not intended to be limiting of the disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items.

Unless specifically stated or obvious from context, as used herein, the terms "about," "approximately," and "substantially" are used interchangeably and can be understood as within a range of normal tolerance in the art of a stated value, for example within 2 standard deviations of the mean. "About," "approximately," and/or substantially can be understood as within 10%, 9%, 8%, 7%, 6%, 5%, 4%, 3%, 2%, 1%, 0.5%, 0.1%, 0.05%, or 0.01% of the stated value. Unless otherwise clear from the context, all numerical values provided herein are modified by the term "about."

Hereinabove, although the present disclosure is described by specific matters such as concrete components, and the like, the exemplary embodiments, and drawings, they are provided merely for assisting in the entire understanding of the present disclosure. Therefore, the present disclosure is not limited to the exemplary embodiments. Various modifications and changes can be made by those skilled in the art to which the disclosure pertains from this description. Therefore, the spirit of the present disclosure should not be limited to the above-described exemplary embodiments, and the following claims as well as all technical spirits modified equally or equivalently to the claims should be interpreted to fall within the scope and spirit of the disclosure.

The invention claimed is:

1. A device comprising:

a housing including a proximal end and a distal end;

an optical window disposed at the proximal end of the housing;

an end-wall plate disposed at the distal end of the housing;

a feedthrough that penetrates through the end-wall plate; and a gas electron multiplier (GEM) board disposed between the optical window and the end-wall plate.

2. The device of claim 1, further comprising a photocathode coated as a thin film on a surface of the optical window.

3. The device of claim 2, wherein the photocathode includes potassium sodium antimonide.

4. The device of claim 1, wherein the feedthrough includes:

an electrically conductive wire that penetrates through the end-wall plate; and a hermetic seal between the electrically conductive wire and the end-wall plate.

5. The device of claim 1, wherein the optical windows includes sapphire.

6. The device of claim 1, wherein the housing includes titanium or aluminum.

7. The device of claim 1, further comprising a gas mix, wherein the gas mix includes a proportional gas.

8. The device of claim 7, wherein the proportional gas includes one of Group 18 of the periodic table or nitrogen.

9. The device of claim 8, wherein the proportional gas is nitrogen.

10. The device of claim 7, wherein the gas mix further includes a quench gas.

11. The device of claim 10, wherein the quench gas includes one of $CO_2$, $CH_4$, or $CF_4$.

12. The device of claim 2, wherein the photocathode includes at least one layer of vapor deposited material.

13. The device of claim 12, wherein a thickness of one or more of the at least one layer of vapor deposited material is less than or equal to 200 nanometers.

14. The device of claim 12, wherein each of the at least one layer of vapor deposited material includes a minimum of 90 weight-% of one or more material selected from the group consisting of: Antimony (Sb), Antimony, compound with potassium (1:1) (KSb), Antimony, compound with potassium (2:1) ($KSb_2$), Antimony, compound with potassium (5:4) ($K_5Sb_4$), Antimony Trioxide ($Sb_2O_3$), Cesium (Cs), Cesium Antimonide ($Cs_3Sb$), Gallium Arsenide (GaAs), Gallium Arsenide with Cesium (GaAs(Cs)), Cesium Bismuthide ($Cs_3Bi$), Cesium Bismuthide with Oxygen ($Cs_3Bi(O)$), Cesium Bismuthide with Silver ($Cs_3Bi(Ag)$), Cesium Iodide (CsI), Cesium Oxide ($Cs_2O$), Cesium Telluride ($Cs_2Te$), Gallium Aluminum Arsenide ($Ga_{0.25}Al_{0.75}As$), Gallium Arsenide Phosphide ($GaAs_{1-x}P_x$), Gallium Arsenide Phosphide with Cesium ($GaAs_{1-x}P_x(Cs)$), Gallium Nitride (GaN), Gallium Nitride with Cesium (GaN (Cs)), Gallium Phosphide (GaP), Indium Gallium Arsenide (InGaAs), Indium Gallium Arsenide with Cesium (InGaAs (Cs)), Indium Gallium Arsenide Phosphide (InGaAsP), Indium Gallium Arsenide Phosphide with Cesium (InGaAsP (Cs)), Indium Phosphide (InP), Lithium Antimonide ($Li_3Sb$), Oxygen (O), Potassium (K), Potassium Antimonide ($K_3Sb$), Potassium Bromide (KBr), Potassium Cesium Antimonide ($K_2CsSb$), Potassium Chloride (KCl), Potassium Oxide ($K_2O$), Potassium Sodium Cesium Antimonide ((Cs) $Na_2KSb$), Sodium (Na), Sodium Antimonide ($Na_3Sb$), Sodium Arsenide ($Na_3As$), Sodium Cesium Antimonide ($Na_2CsSb$), Sodium Oxide ($Na_2O$), Sodium Potassium Antimonide ($Na_2KSb$), Rubidium Cesium Antimonide ($Rb_2CsSb$), Silver (Ag), Silver Bismuth Oxygen Cesium (Ag—Bi—O—Cs), Silicon-Carbide (SiC), and Silver Oxygen Cesium (Ag—O—Cs).

15. The device of claim 12, wherein each of the at least one layer of vapor deposited material includes a minimum of 90 weight-% of one or more material selected from the group consisting of: Aluminum (Al), Antimony (Sb), Arsenic (As), Bismuth (Bi), Bromine (Br), Cesium (Cs), Chlorine (Cl), Gallium (Ga), Indium (In), Lithium (Li), Oxygen (O), Phosphorous (P), Potassium (K), Rubidium (Rb), Silver (Ag), Sodium (Na), and Tellurium (Te).

16. The device of claim 12, wherein each of the at least one layer of vapor deposited material includes a minimum of 90 weight-% of one or more material selected from the group consisting of: Silicon (Si), Boron Nitride (BN), Titanium Dioxide ($TiO_2$), Silicon Carbide (SiC), and Silicon Dioxide ($SiO_2$).

17. The device of claim 2, wherein an electric potential difference is applied between the photocathode and the GEM board.

18. The device of claim 1, further comprising a readout anode.

19. The device of claim 1, further comprising a focusing element including conducting cylinders or rings.

20. The device of claim 1, wherein the housing is cylindrical.

* * * * *